US006488563B1

(12) United States Patent
Isaacson

(10) Patent No.: US 6,488,563 B1
(45) Date of Patent: Dec. 3, 2002

(54) TOY VEHICLE

(76) Inventor: J. Terrell Isaacson, 1430 S. State St., Genola, UT (US) 84655

( * ) Notice: Subject to any disclaimer, the term of this patent is extended or adjusted under 35 U.S.C. 154(b) by 0 days.

(21) Appl. No.: 10/083,732

(22) Filed: Feb. 27, 2002

(51) Int. Cl.[7] ..... A63H 33/02
(52) U.S. Cl. ..... 446/450; 446/465; 446/470
(58) Field of Search ..... 446/93, 95, 431, 446/448, 450, 451, 428, 460, 465, 468, 470; 280/47.11

(56) References Cited

U.S. PATENT DOCUMENTS

| | | | | | |
|---|---|---|---|---|---|
| 991,276 | A | * | 5/1911 | Clark | 280/93.504 |
| 2,167,245 | A | * | 7/1939 | Lohr et al. | 446/451 |
| 2,260,679 | A | * | 10/1941 | Neilson | 446/428 |
| 2,647,343 | A | * | 8/1953 | Zileri et al. | 280/267 |
| 2,887,823 | A | * | 5/1959 | Vaughan | 446/451 |
| 2,946,153 | A | * | 7/1960 | Ernst | 273/110 |
| 3,762,096 | A | * | 10/1973 | Reyes | 446/451 |
| 4,577,528 | A | * | 3/1986 | Hanzawa | 446/443 |
| 4,595,380 | A | * | 6/1986 | Magers | 446/437 |
| 4,741,718 | A | * | 5/1988 | Moolman | 446/451 |
| 5,000,716 | A | * | 3/1991 | Canavesi | 280/89.11 |
| 5,240,451 | A | * | 8/1993 | Clark, Jr. | 446/431 |
| 5,906,383 | A | * | 5/1999 | Cortes | 280/47.371 |
| 6,302,421 | B1 | * | 5/2000 | Lee | 280/210 |

* cited by examiner

*Primary Examiner*—Jacob K. Ackun
*Assistant Examiner*—Bena B. Miller

(57) ABSTRACT

A toy vehicle for allowing a child to steer a simulated toy vehicle while standing up and walking behind the simulated toy vehicle. The toy vehicle includes a wire frame formed into a simulated shape of a vehicle; and also includes a wheel assembly upon which the wire frame is mounted and includes front and rear axles and wheels mounted to the front and rear axles; and further includes an assembly for steering the toy vehicle.

9 Claims, 5 Drawing Sheets

TOY VEHICLE

BACKGROUND OF THE INVENTION

1. Field of the Invention

The present invention relates to child's steer-able toy vehicles and more particularly pertains to a new toy vehicle for allowing a child to steer a simulated toy vehicle while standing up and walking behind the simulated toy vehicle.

2. Description of the Prior Art

The use of child's steer-able toy vehicles is known in the prior art. More specifically, child's steer-able toy vehicles heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 2,260,679; U.S. Pat. No. 1,996,546; U.S. Pat. No. Des. 284,984; U.S. Pat. No. 3,762,096; U.S. Pat. No. 2,887,823; and U.S. Pat. No. 4,007,646.

While these devices fulfill their respective, particular objectives and requirements, the aforementioned patents do not disclose a new toy vehicle. The prior art discloses toy vehicles which can also be steered from behind while the child is standing up, but the steering mechanisms limit the maneuverability of the toy vehicle.

SUMMARY OF THE INVENTION

The general purpose of the present invention, which will be described subsequently in greater detail, is to provide a new toy vehicle which has many of the advantages of the child's steer-able toy vehicles mentioned heretofore and many novel features that result in a new toy vehicle which is not anticipated, rendered obvious, suggested, or even implied by any of the prior art child's steer-able toy vehicles, either alone or in any combination thereof. The present invention includes a wire frame formed into a simulated shape of a vehicle; and also includes a wheel assembly upon which the wire frame is mounted and includes front and rear axles and wheels mounted to the-front and rear axles; and further includes an assembly for steering the toy vehicle. The present invention allows the child to greatly maneuver the toy vehicle much like the real thing.

There has thus been outlined, rather broadly, the more important features of the toy vehicle in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new toy vehicle which has many of the advantages of the child's steer-able toy vehicles mentioned heretofore and many novel features that result in a new toy vehicle which is not anticipated, rendered obvious, suggested, or even implied by any of the prior art child's steer-able toy vehicles, either alone or in any combination thereof.

Still another object of the present invention is to provide a new toy vehicle for allowing a child to steer a simulated toy vehicle while standing up and walking behind the simulated toy vehicle.

Still yet another object of the present invention is to provide a new toy vehicle that is easy and convenient to use.

Even still another object of the present invention is to provide a new toy vehicle that allows the child to be creative and also teaches the child the aspects of steering a vehicle and is also entertaining for the child.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
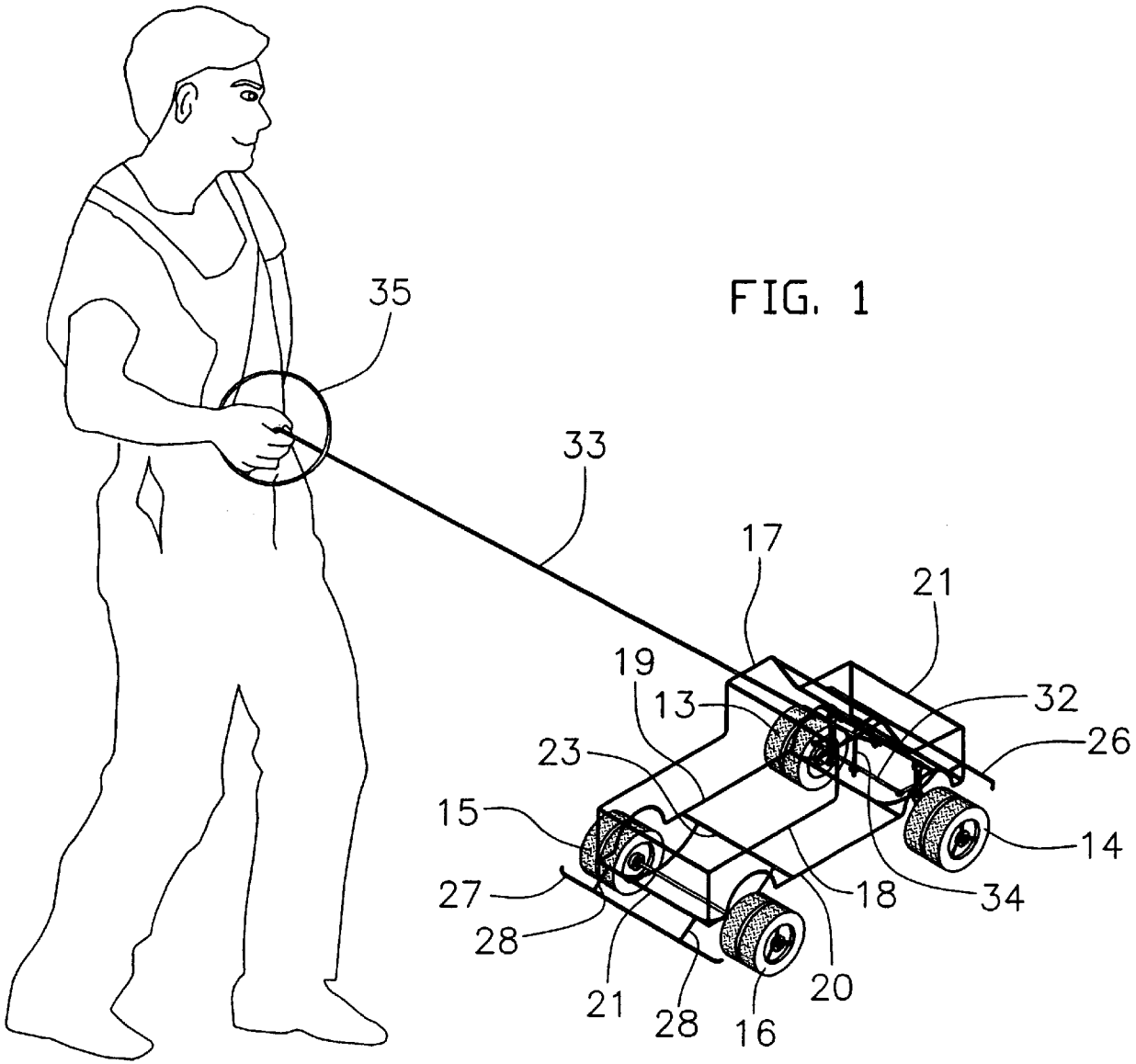
FIG. 1 is a perspective view of a new toy vehicle according to the present invention and shown in use.
Figure 2:
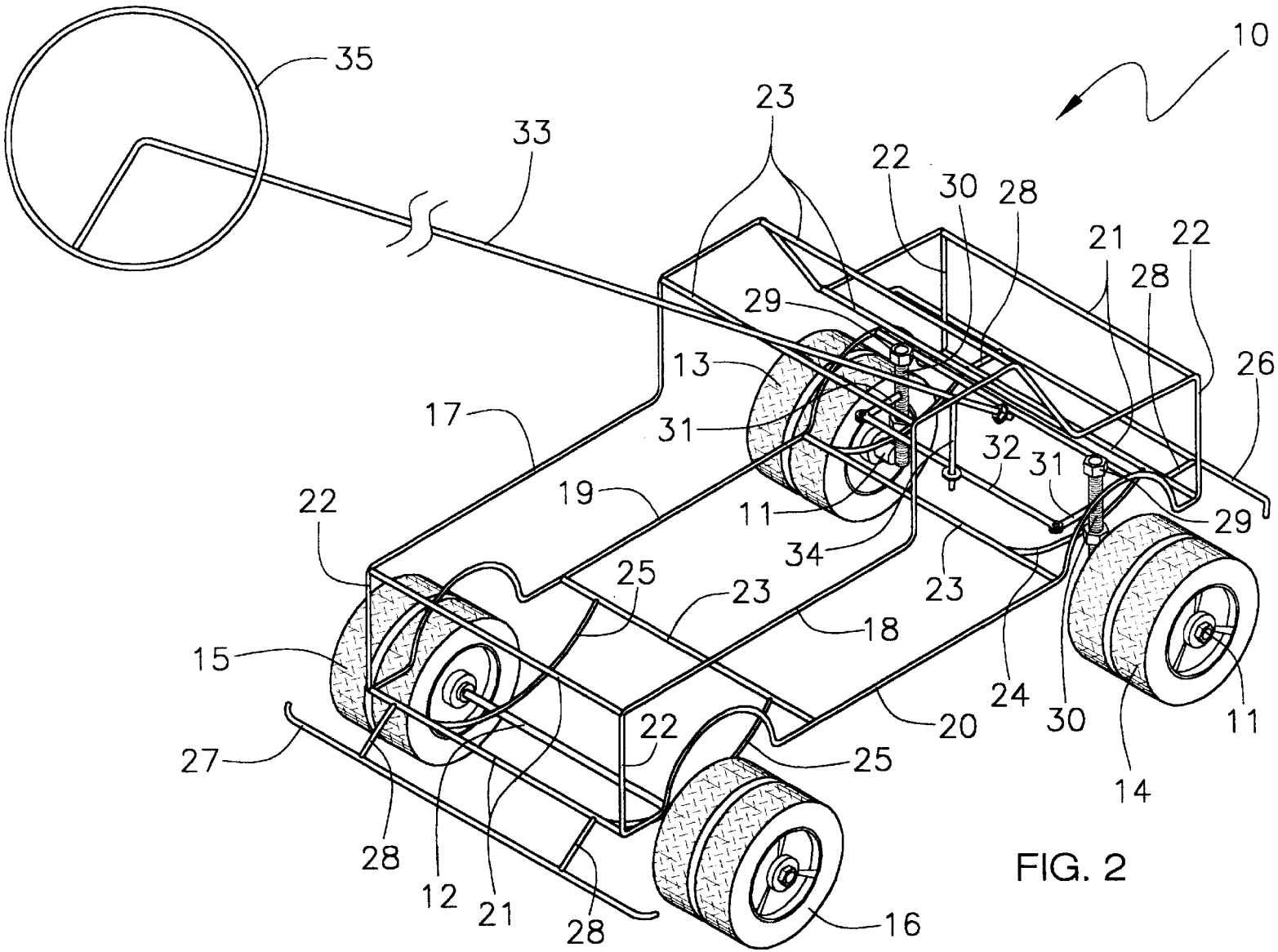
FIG. 2 is another perspective view of the present invention.
Figure 3:
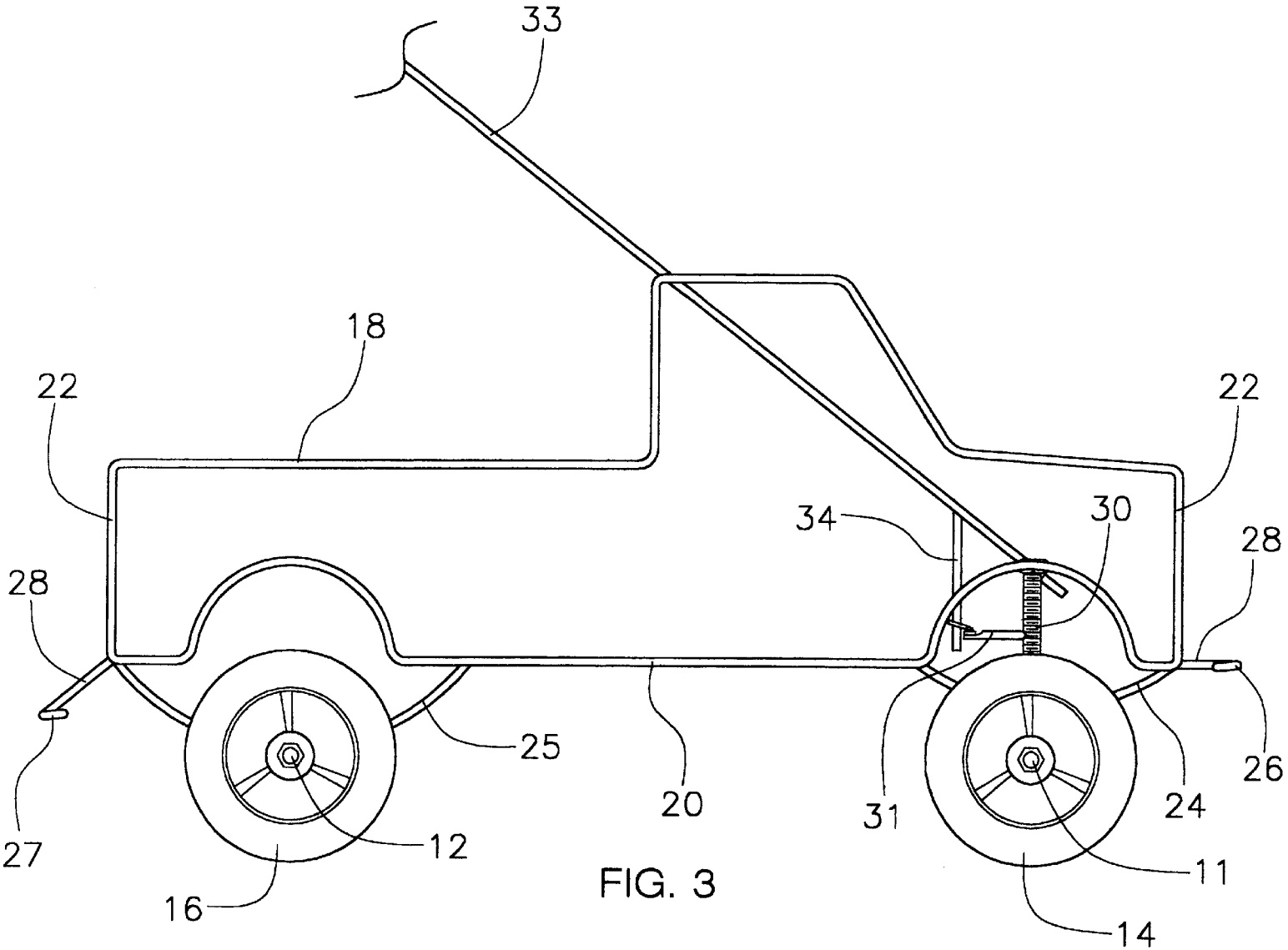
FIG. 3 is a side elevational view of the present invention.
Figure 4:
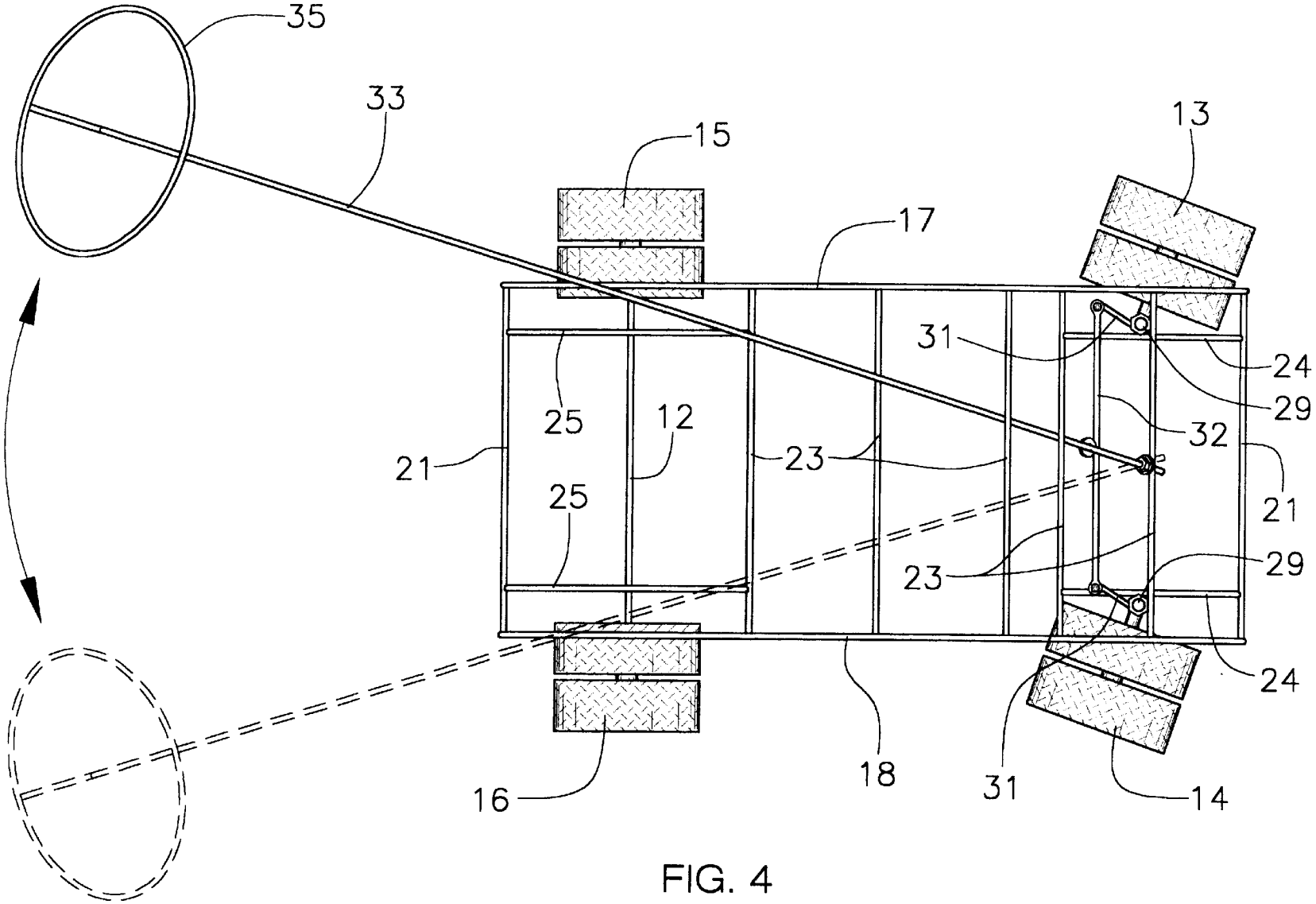
FIG. 4 is a top plan view of the present invention.
Figure 6:
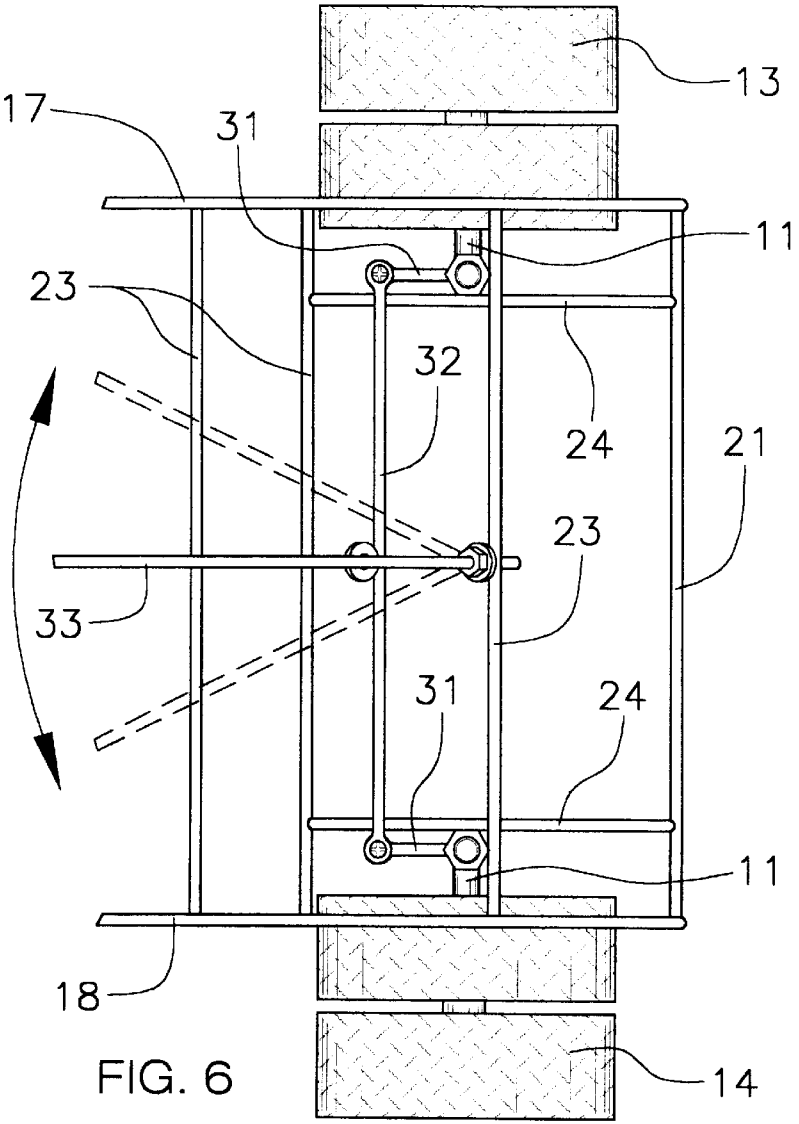
FIG. 6 is a detailed partial top plan view of the present invention.
Figure 5:
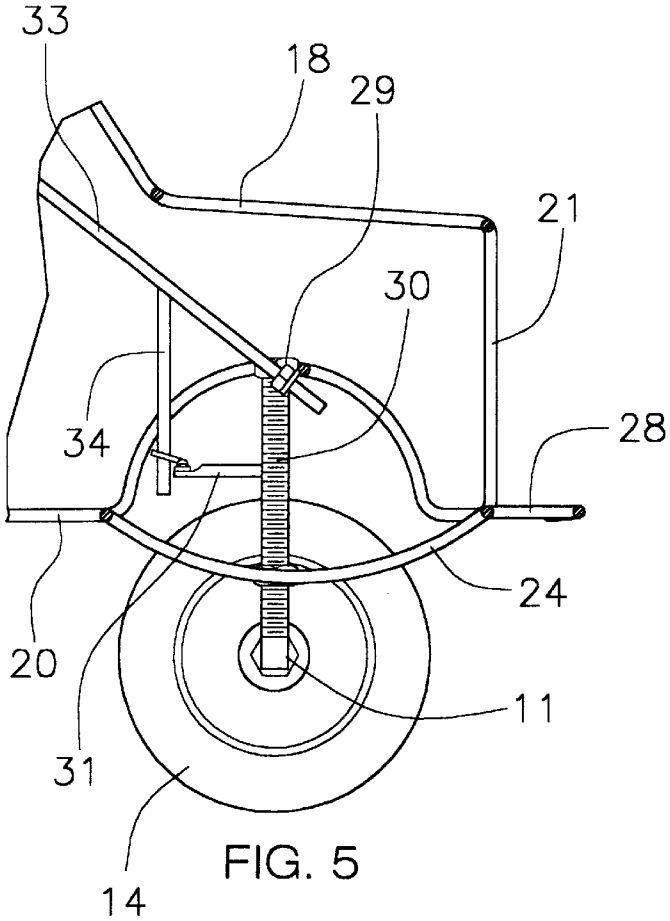
FIG. 5 is a detailed side elevational view of one of the threaded elongate pivot members of the present invention.

With reference now to the drawings, and in particular to FIGS. 1 through 6 thereof, a new toy vehicle embodying the principles and concepts of the present invention and generally designated by the reference numeral 10 will be described.

As best illustrated in FIGS. 1 through 6, the toy vehicle 10 generally comprises a wire frame formed into a simulated shape of a vehicle. The wire frame includes elongate side members 17–20, and also includes elongate first end members 21 conventionally interconnecting the elongate side members 17–20, and further includes second end members 22 also conventionally interconnecting the elongate side members 17–20, and also includes elongate cross members 23 also conventionally interconnecting the elongate side members 17–20, and further includes elongate support members 24,25 being conventionally attached and welded to more than one of the elongate cross members 23 and to the elongate first end members 21. The elongate side members 17–20 include upper side members 17,18 and lower side members 19,20 being conventionally interconnected with the second end members 22. Each of the upper side members 17,18 includes a bended intermediate portion forming, in combination with the lower side members 19,20 a simulated passenger compartment. Each of the lower side members 19,20 includes front and rear arcuate portions forming simulated wheels wells. The elongate support members 24,25 are longitudinally curved and bowed downwardly relative to a surface upon which the toy vehicle 10 moves. The elongate support members 24,25 includes rear support members 25 which are conventionally mounted and welded upon the rear axle 12, and also includes front support members 24. The wire frame further includes elongate front and rear bumpers 26,27, and also includes brace members 28 being conventionally attached to the elongate front and rear bumpers 26,27 and to the elongate first end members 21. A wheel assembly upon which the wire frame is mounted includes front and rear axles 11,12 and wheels 13–16 being conventionally mounted to the front and rear axles 11,12.

A means for steering the toy vehicle 10 includes threaded support members 29 which are securely and conventionally attached and welded to one or more of the elongate cross members 23 of the wire frame and to the elongate front support members 24, and also includes a pair of elongate threaded pivot members 30 being disposed generally vertically. Each of the elongate threaded pivot members 30 is securely and conventionally attached and welded to a respective front axle 11 and is threaded to a respective threaded support member 29, and further includes linkages 31 being securely and conventionally attached to and extending generally perpendicular from the elongate threaded pivot members 30, and also includes an elongate tie member 32 being pivotally and conventionally attached to the linkages 31, and further includes an elongate primary steering member 33 being pivotally and conventionally attached to one of the elongate cross members 23 and also includes a secondary steering member 34 being conventionally attached and welded to the elongate tie member 32 and to the elongate primary steering member 33 for pivoting the elongate threaded pivot members 30, and further includes a handle 35 being conventionally attached to the elongate primary steering member 33. The threaded support members 29 are generally threaded fastening nuts. The elongate threaded pivot members 30 have bottom ends which are securely and conventionally attached to the front axles 11.

In use, the child or person grasps the steering wheel 30 from behind the toy vehicle 10 and either pushes or pulls the toy vehicle 10 and turns the vehicle in whatever chosen direction by turning the elongate primary steering member 33.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the toy vehicle. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A toy vehicle comprising:

a wire frame formed into a simulated shape of a vehicle;

a wheel assembly upon which said wire frame is mounted and includes front and rear axles and wheels mounted to said front and rear axles, said wire frame including elongate side members, and also includes elongate first end members interconnecting said elongate side members, and further including second end members also interconnecting said elongate side members, and also including elongate cross members also interconnecting said elongate side members, and further including elongate support members being attached to more than one of said elongate cross members and to said elongate first end members; and a means for steering said toy vehicle.

2. A toy vehicle as described in claim 1, wherein said elongate side members include upper side members and lower side members being interconnected by said second end members.

3. A toy vehicle as described in claim 2, wherein each of said upper side members includes a bended intermediate portion forming, in combination with said lower side members, a simulated passenger compartment.

4. A toy vehicle as described in claim 3, wherein each of said lower side members includes front and rear arcuate portions forming simulated wheels wells.

5. A toy vehicle as described in claim 4, wherein said elongate support members are longitudinally curved and bowed downwardly relative to a surface upon which said toy vehicle moves, said elongate support members including elongate rear support members which are mounted upon said rear axle, and also including elongate front support members.

6. A toy vehicle as described in claim 5, wherein said wire frame further includes elongate front and rear bumpers, and also includes brace members being attached to said elongate front and rear bumpers and to said elongate first end members.

7. A toy vehicle as described in claim 5, wherein said means for steering said toy vehicle includes threaded support members which are securely attached to one or more of said elongate cross members of said wire frame and to said elongate front support members, and also includes a pair of elongate threaded pivot members being disposed generally vertically with each of said elongate threaded pivot members being securely attached to a respective said front axle and being threaded to a respective said threaded support member, and further includes linkages being securely attached to and extending generally perpendicular from said elongate threaded pivot members, and also includes an elongate tie member being pivotally attached to said linkages, and further includes an elongate primary steering member being pivotally attached to one of said elongate cross members and also includes a secondary steering member being attached to said elongate tie member and to said elongate primary steering member for pivoting said elongate threaded pivot members, and further including a handle being attached to said elongate primary steering member.

8. A toy vehicle as described in claim 7, wherein said threaded support members are generally threaded fastening nuts.

9. A toy vehicle as described in claim 8, wherein said elongate threaded pivot members have bottom ends which are securely attached to said front axles.

* * * * *